US009207565B2

(12) United States Patent
Shimizu et al.

(10) Patent No.: US 9,207,565 B2
(45) Date of Patent: Dec. 8, 2015

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Tamotsu Shimizu, Osaka (JP); Shizuka Ikazaki, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/643,423

(22) Filed: Mar. 10, 2015

(65) Prior Publication Data

US 2015/0261126 A1 Sep. 17, 2015

(30) Foreign Application Priority Data

Mar. 17, 2014 (JP) ..... 2014-052914

(51) Int. Cl.
*G03G 15/06* (2006.01)
*G03G 15/09* (2006.01)

(52) U.S. Cl.
CPC ..... *G03G 15/065* (2013.01); *G03G 15/0907* (2013.01)

(58) Field of Classification Search
CPC ..... G03G 15/065; G03G 15/0907; G03G 15/0813
See application file for complete search history.

(56) References Cited

U.S. PATENT DOCUMENTS

2010/0054820 A1* 3/2010 Fujihara ..... G03G 15/065 399/270
2010/0111551 A1* 5/2010 Fujihara ..... G03G 15/065 399/55
2010/0129102 A1* 5/2010 Fujihara ..... G03G 15/065 399/55
2014/0294409 A1* 10/2014 Murata ..... G03G 15/161 399/44
2014/0294410 A1* 10/2014 Hayashi ..... G03G 21/203 399/44
2014/0308053 A1* 10/2014 Tsukahara ..... G03G 15/0266 399/96
2014/0321869 A1* 10/2014 Fujihara ..... G03G 15/0907 399/55

FOREIGN PATENT DOCUMENTS

JP 2010-085592 4/2010

* cited by examiner

*Primary Examiner* — David Gray
*Assistant Examiner* — Carla Therrien
(74) *Attorney, Agent, or Firm* — Gerald E. Hespos; Michael J. Porco; Matthew T. Hespos

(57) ABSTRACT

A developing device includes a development housing, a developer carrier, a toner carrier, a bias applying unit, a leakage detecting unit, a bias control unit and a leakage detection control unit. The developer carrier carries a developer layer. The toner carrier receives the toner from the developer layer and supplies the toner to an image carrier. The bias applying unit includes one transformer and applies direct-current voltages and alternating-current voltages to the developer carrier and the toner carrier. The leakage detecting unit detects leakage occurring between the image carrier and the toner carrier or between the toner carrier and the developer carrier. The leakage detection control unit detects a value of an inter-peak voltage at which the leakage occurs and determines whether the leakage occurs between the image carrier and the toner carrier or between the toner carrier and the developer carrier.

7 Claims, 12 Drawing Sheets

FIG.10

| | | | | | | | POTENTIAL DIFFERENCE | | | |
|---|---|---|---|---|---|---|---|---|---|---|
| | DEVELOPING ROLLER | | | MAGNETIC ROLLER | | | INTERVAL DS | | INTERVAL MS | |
| POTENTIAL CONDITIONS (V) | Vslpp | Vmaxsl | Vminsl | Vmgpp | Vmaxmg | Vminmg | IMAGE PART (VRd(DS)) | BACKGROUND PART | RETURN (VRd(MS)) | FEED |
| | 1000 | 980 | −20 | 600 | 712 | 112 | 880 | 450 | 868 | 732 |

FIG.11

| Vslpp(V) | LEAKAGE DETECTION NUMBER | REMARKS |
|---|---|---|
| 800 | 0 | |
| 850 | 0 | |
| 900 | 0 | |
| 950 | 0 | |
| 1000 | 0 | |
| 1050 | 0 | |
| 1100 | 0 | |
| 1150 | 0 | |
| 1200 | 0 | |
| 1250 | 0 | |
| 1300 | 0 | |
| 1350 | 0 | |
| 1400 | 5 | ROUGH LEAKAGE DETECTION |
| 1360 | 0 | |
| 1370 | 2 | FIRST LEAKAGE DETECTION |
| 1380 | 4 | SECOND LEAKAGE DETECTION |
| T | 2 | |

FIG.12

| Vslpp(V) | LEAKAGE DETECTION NUMBER | REMARKS |
|---|---|---|
| 800 | 0 | |
| 850 | 0 | |
| 900 | 0 | |
| 950 | 0 | |
| 1000 | 0 | |
| 1050 | 0 | |
| 1100 | 0 | |
| 1150 | 0 | |
| 1200 | 0 | |
| 1250 | 0 | |
| 1300 | 35 | ROUGH LEAKAGE DETECTION |
| 1260 | 0 | |
| 1270 | 2 | FIRST LEAKAGE DETECTION |
| 1280 | 15 | SECOND LEAKAGE DETECTION |
| T | 7.5 | |

DEVELOPING DEVICE AND IMAGE FORMING APPARATUS PROVIDED WITH SAME

INCORPORATION BY REFERENCE

This application is based on Japanese Patent Application No. 2014-052914 filed with the Japan Patent Office on Mar. 17, 2014, the contents of which are hereby incorporated by reference.

BACKGROUND

The present disclosure relates to a developing device and an image forming apparatus provided with the same.

An image forming apparatus adopting an electrophotographic method such as a copier, a printer or a facsimile machine forms a toner image on an image carrier (e.g. photoconductive drum or transfer belt) by supplying toner to an electrostatic latent image formed on the image carrier to develop the electrostatic latent image. A touch-down development method using a two-component developer containing nonmagnetic toner and magnetic carrier is known as one of methods for performing the above development. In this case, a two-component developer layer (so-called magnetic brush layer) is carried on a magnetic roller, the toner is transferred from the two-component developer layer onto a developing roller and a toner layer is carried on the developing roller. Further, the electrostatic latent image is visualized by the supply of the toner from the toner layer to the image carrier. Conventionally, there has been known a technology on a leakage detecting operation for detecting a leakage voltage, at which leakage occurs, by changing inter-peak voltages of alternating-current voltages in a developing device adopting the touch-down development method.

SUMMARY

A developing device according to one aspect of the present disclosure includes a development housing, a developer carrier, a toner carrier, a bias applying unit, a leakage detecting unit, a bias control unit and a leakage detection control unit. The development housing stores a developer containing toner to be charged to a predetermined polarity and carrier. The developer carrier receives the developer in the development housing and carries a developer layer by being rotated. The toner carrier receives the toner from the developer layer, carries a toner layer and supplies the toner to an image carrier having an electrostatic latent image formed on a surface and carrying a toner image developed by the toner by being rotated in a state in contact with the developer layer. The bias applying unit includes one transformer and applies direct-current voltages and alternating-current voltages having the same frequency and phases opposite to each other to the developer carrier and the toner carrier. The leakage detecting unit detects leakage occurring between the image carrier and the toner carrier or leakage occurring between the toner carrier and the developer carrier. The bias control unit provides a predetermined potential difference of the direct-current voltage between the toner carrier and the developer carrier and applies the alternating-current voltages so that the toner is transferred from the developer carrier to the toner carrier by controlling the bias applying unit during a developing operation in which the toner is supplied from the toner carrier to the image carrier. The leakage detection control unit detects a value of an inter-peak voltage, at which the leakage occurs, by changing inter-peak voltages in a state where a ratio of the inter-peak voltages of the alternating-current voltages applied to the toner carrier and the developer carrier is fixed and determines whether the leakage occurs between the image carrier and the toner carrier or between the toner carrier and the developer carrier during a leakage detecting operation different from the developing operation. The bias control unit sets a value obtained by subtracting a first offset voltage set in advance from a first inter-peak voltage as the inter-peak voltage of the alternating-current voltage to be applied during the next developing operation if the occurrence of leakage between the image carrier and the toner carrier at the first inter-peak voltage is determined by the leakage detection control unit and sets a value obtained by subtracting a second offset voltage set in advance and larger than the first offset voltage from the first inter-peak voltage as the inter-peak voltage of the alternating-current voltage to be applied during the next developing operation if the occurrence of leakage between the developer carrier and the toner carrier at the first inter-peak voltage is determined by the leakage detection control unit.

An image forming apparatus according to another aspect of the present disclosure includes the above developing device and the image carrier configured to carry the electrostatic latent image and the toner image.

BRIEF DESCRIPTION OF THE DRAWINGS

FIG. 10 is a table showing potential conditions of development biases during the developing operation of the developing device according to the embodiment of the present disclosure, FIG. 11 is a table showing steps of the leakage detecting operation of the developing device according to the embodiment of the present disclosure, and FIG. 12 is a table showing steps of the leakage detecting operation of the developing device according to the embodiment of the present disclosure.

DETAILED DESCRIPTION

Hereinafter, an embodiment of the present disclosure is described in detail based on the drawings. Note that the present disclosure can be applied to an image forming apparatus adopting an electrophotographic method such as a copier, a printer, a facsimile or a complex machine provided with these functions.

Figure 1:
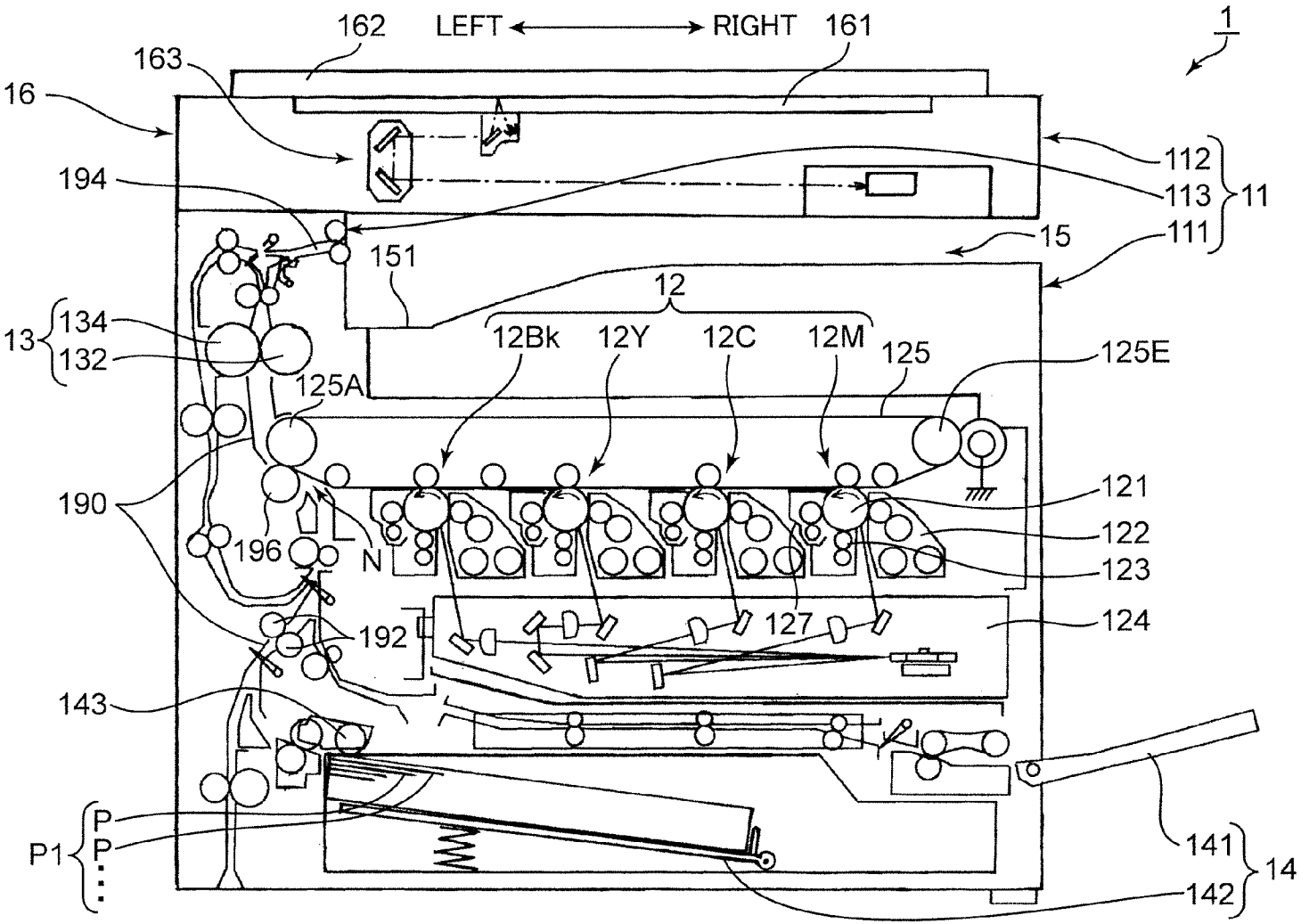
FIG. 1 is a sectional view showing an internal structure of an image forming apparatus according to an embodiment of the present disclosure.

FIG. 1 is a front view in section showing the structure of an image forming apparatus 1 according to one embodiment of the present disclosure. The image forming apparatus 1 includes an image forming station 12, a fixing device 13, a sheet feeding unit 14, a sheet discharging unit 15, a document reading unit 16 and the like in an apparatus main body 11.

The apparatus main body 11 includes a lower main body 111, an upper main body 112 arranged to face the lower main body 111 from above and a coupling portion 113 interposed between these upper and lower main bodies 112, 111. The coupling portion 113 is a structure for coupling the lower and upper main bodies 111, 112 to each other in a state where the sheet discharging unit 15 is formed between the both, and stands on a left part and a rear part of the lower main body 111 to be L-shaped in a plan view. The upper main body 112 is supported on an upper end part of the coupling portion 113.

The image forming station 12, the fixing device 13 and the sheet feeding unit 14 are housed in the lower main body 111 and the document reading unit 16 is housed in the upper main body 112.

The image forming station 12 performs an image forming operation of forming a toner image on a sheet P fed from the sheet feeding unit 14. The image forming station 12 includes a magenta unit 12M using magenta toner, a cyan unit 12C using cyan toner, a yellow unit 12Y using yellow toner and a black unit 12Bk using black toner successively arranged from an upstream side toward a downstream side in a horizontal direction, an intermediate transfer belt 125 and a secondary transfer roller 196 held in contact with the outer peripheral surface of the intermediate transfer belt 125.

The unit of each color of the image forming station 12 integrally includes a photoconductive drum 121, a developing device 122, a toner cartridge (not shown) containing the toner, a charging device 123 and a drum cleaning device 127. Further, an exposure device 124 for exposing each photoconductive drum 121 to light is horizontally arranged below the adjacent developing devices 122.

The photoconductive drum 121 has an electrostatic latent image formed on the circumferential surface thereof and carries a toner image obtained by developing the electrostatic latent image by the toner. The developing device 122 supplies the toner to an electrostatic latent image on the circumferential surface of the photoconductive drum 121 rotating in a direction of an arrow to form a toner image corresponding to image data on the circumferential surface of the photoconductive drum 121. The toner is appropriately supplied to each developing device 122 from the toner cartridge. The charging device 123 uniformly charges the circumferential surface of the photoconductive drum 121. The exposure device 124 irradiates the charged circumferential surface of the photoconductive drum 121 with laser light corresponding to each color based on image data input from a computer or the like or image data obtained by the document reading unit 16, thereby forming an electrostatic latent image on the circumferential surface of each photoconductive drum 121. Note that the exposure device 124 irradiates the laser light according to an exposure light amount set in advance in order to form a predetermined latent image potential on the photoconductive drum 121. The drum cleaning device 127 cleans the circumferential surface of the photoconductive drum 121 by removing the residual toner.

The intermediate transfer belt 125 is an endless, electrically conductive and soft belt. The intermediate transfer belt 125 is mounted on a plurality of tension rollers arranged substantially in the horizontal direction. The tension rollers include a drive roller 125A arranged near the fixing device 13 to rotationally drive the intermediate transfer belt 125 and a driven roller 125E arranged at a predetermined distance from the drive roller 125A in the horizontal direction and configured to rotate, following the rotation of the intermediate transfer belt 125. The intermediate transfer belt 125 is driven to rotate in a clockwise direction in FIG. 1.

A secondary transfer bias applying unit (not shown) is electrically connected to the secondary transfer roller 196. A toner image formed on the intermediate transfer belt 125 is transferred to a sheet P conveyed from a pair of conveyor rollers 192 located below by a transfer bias applied between the secondary transfer roller 196 and the drive roller 125A.

The fixing device 13 includes a heating roller 132 integrally provided with a heating source and a pressure roller 134 arranged to face the heating roller 132. The fixing device 13 applies a fixing process to a toner image on a sheet P transferred in the image forming station 12. The color-printed sheet P completed with the fixing process is discharged toward a sheet discharge tray 151 provided on the top of the apparatus main body 11 through a sheet discharge conveyance path 194 extending from an upper part of the fixing device 13.

The sheet feeding unit 14 includes a manual feed tray 141 and a sheet cassette 142. The sheet cassette 142 stores a sheet stack P1 formed by stacking a plurality of sheets P. A pickup roller 143 is provided above the sheet cassette 142 and feeds the uppermost sheet P of the sheet stack P1 stored in the sheet cassette 142 to a sheet conveyance path 190. The manual feed tray 141 is a tray for manually feeding sheets P one by one toward the image forming station 12.

The vertically extending sheet conveyance path 190 is formed to the left of the image forming station 12. The pair of conveyor rollers 192 are provided at a suitable position in the sheet conveyance path 190 and conveys a sheet P fed from the sheet feeding unit 14 toward a secondary transfer nip portion formed by the secondary transfer roller 196. The sheet discharging unit 15 is formed between the lower and upper main bodies 111, 112. The sheet discharging unit 15 includes the sheet discharge tray 151 formed on the upper surface of the lower main body 111.

The document reading unit 16 includes a contact glass 161 which is mounted in an upper surface opening of the upper main body 112 and on which a document is to be placed, a document pressing cover 162 which is free to open and close and presses a document placed on this contact glass 161 and a scanning mechanism 163 which scans and reads an image of a document placed on the contact glass 161. The scanning mechanism 163 optically reads an image of a document using an image sensor and generates image data. Further, the apparatus main body 11 includes an image processing unit (not shown) for generating an image from this image data.

<Configuration of the Developing Device>

Figure 2:
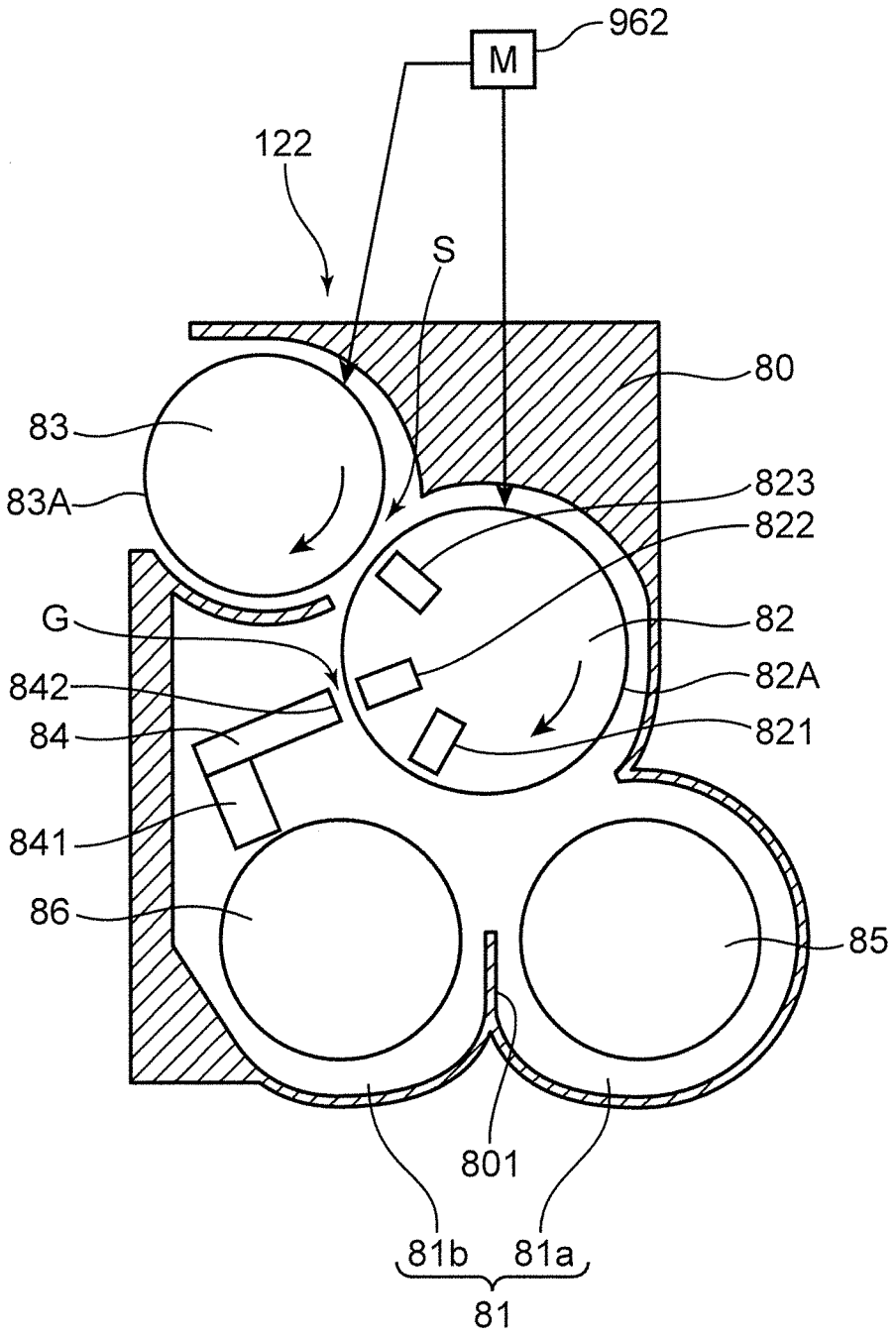
FIG. 2 is a sectional view of a developing device according to the embodiment of the present disclosure.
Figure 3:
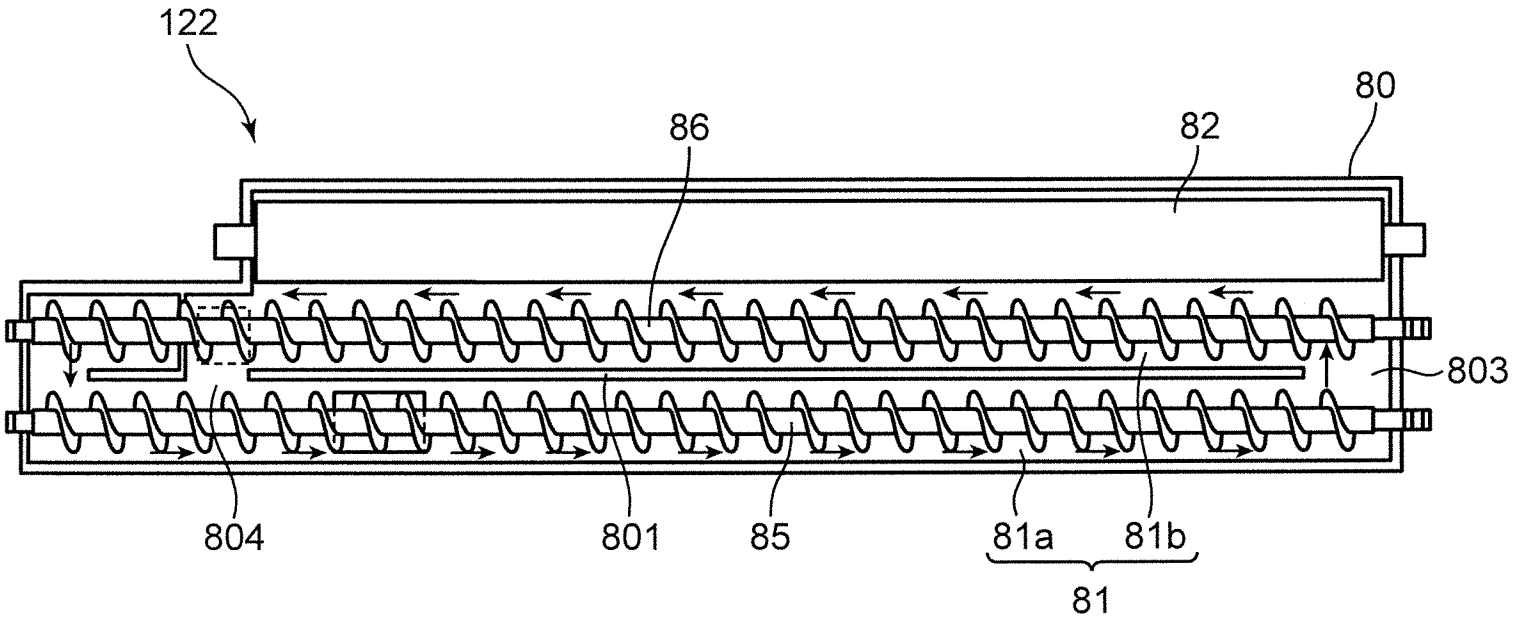
FIG. 3 is a plan view showing an internal structure of the developing device according to the embodiment of the present disclosure.

Next, the developing device 122 is described in detail. FIG. 2 is a vertical and lateral sectional view schematically showing an internal structure of the developing device 122, and FIG. 3 is a plan view showing the internal structure of the developing device 122. The developing device 122 includes a development housing 80 defining an internal space of the developing device 122. This development housing 80 includes a developer storage 81 for storing a developer containing nonmagnetic toner to be charged to a predetermined polarity and magnetic carrier. As an example, an average particle diameter of the toner is 6.8 μm. Further, a magnetic roller 82 (developer carrier) arranged above the developer storage 81, a developing roller 83 (toner carrier) arranged to face the magnetic roller 82 at a position obliquely above the magnetic roller 82 and a developer regulation blade 84 arranged to face the magnetic roller 82 are arranged in the development housing 80.

The developer storage 81 includes two adjacent developer storage chambers 81*a*, 81*b* extending in a longitudinal direction of the developing device 122. The developer storage chambers 81*a*, 81*b* are partitioned by a partition plate 801 that is integrally formed to the development housing 80 and extending in the longitudinal direction, but communicate with each other through communication paths 803, 804 at opposite end parts in the longitudinal direction as shown in FIG. 3. Screw feeders 85, 86 for agitating and conveying the developer by rotating about their axes are housed in the respective developer storage chambers 81*a*, 81*b*. The screw feeders 85, 86 are rotationally driven by an unillustrated driving mechanism, and rotating directions thereof are set to be opposite to each other. In this way, the developer is conveyed in a circulating manner between the developer storage chambers 81*a*, 81*b* while being agitated as shown by an arrow in FIG. 3. By this agitation, the toner and the carrier are mixed and the toner is positively charged in this embodiment.

The magnetic roller 82 is arranged along the longitudinal direction of the developing device 122 and rotationally driven in a clockwise direction in FIG. 2. A fixed so-called magnet roll (not shown) is arranged in the magnetic roller 82. The magnet roll includes a plurality of poles, in this embodiment, a draw-up pole 821, a regulating pole 822 and a main pole 823. The draw-up pole 821 faces the developer storage 81, the regulating pole 822 faces the developer regulation blade 84 and the main pole 823 faces the developing roller 83. Further, the magnetic roller 82 is rotated in a direction opposite to the developing roller 83 (counter direction) at a facing position at a circumferential speed which is 1.5 times as fast as that of the developing roller 83.

The magnetic roller 82 magnetically draws up (receives) the developer onto a circumferential surface 82A thereof from the developer storage 81 by a magnetic force of the draw-up pole 821. The magnetic roller 82 magnetically carries the drawn-up developer as a developer layer (magnetic brush layer) on the circumferential surface 82A. With the rotation of the magnetic roller 82, the developer is conveyed toward the developer regulation blade 84.

The developer regulation blade 84 is arranged upstream of the developing roller 83 when viewed in a rotating direction of the magnetic roller 82 and regulates a layer thickness of the developer layer magnetically adhering to the circumferential surface 82A of the magnetic roller 82. The developer regulation blade 84 is a plate member made of a magnetic material and extending along a longitudinal direction of the magnetic roller 82 and supported by a predetermined supporting member 841 fixed at a suitable position of the development housing 80. Further, the developer regulation blade 84 has a regulation surface 842 (i.e. tip surface of the developer regulation blade 84) for forming a regulation gap G of a predetermined dimension between the regulation surface 842 and the circumferential surface 82A of the magnetic roller 82.

The developer regulation blade 84 formed of the magnetic material is magnetized by the regulating pole 822 of the magnetic roller 82. In this way, a magnetic path is formed between the regulation surface 842 of the developer regulation blade 84 and the regulating pole 822, i.e. in the regulation gap G. When the developer layer adhering to the circumferential surface 82A of the magnetic roller 82 by the draw-up pole 821 is conveyed into the regulation gap G with the rotation of the magnetic roller 82, the layer thickness of the developer layer is regulated in the regulation gap G. In this way, the uniform developer layer having a predetermined thickness is formed on the circumferential surface 82A.

The developing roller 83 is arranged to extend along the longitudinal direction of the developing device 122 and in parallel to the magnetic roller 82 and rotationally driven in a clockwise direction in FIG. 2. The developing roller 83 has a circumferential surface 83A for carrying a toner layer by receiving the toner from the developer layer while rotating in a state in contact with the developer layer held on the circumferential surface 82A of the magnetic roller 82. At the time of a developing operation during an image forming operation, the developing roller 83 supplies the toner of the toner layer to the circumferential surface of the photoconductive drum 121. In this embodiment, the developing roller 83 is a roller formed by applying resin coating (urethane coating) to an alumite surface. Further, the developing roller 83 is rotated in the same direction as the photoconductive drum 121 (with rotation) at a facing position at a circumferential speed which is 1.3 times as fast as that of the photoconductive drum 121.

The developing roller 83 and the magnetic roller 82 are rotationally driven by a driving unit 962 to be described later. A clearance S of a predetermined dimension is formed between the circumferential surface 83A of the developing roller 83 and the circumferential surface 82A of the magnetic roller 82. The clearance S is, for example, set at 0.3 mm. The developing roller 83 is arranged to face the photoconductive drum 121 through an opening formed on the development housing 80 and a clearance of a predetermined dimension is also formed between the circumferential surface 83A and the circumferential surface of the photoconductive drum 121. In this embodiment, this clearance is set at 0.12 mm.

<Electrical Configuration, Block Diagram>

Figure 4:
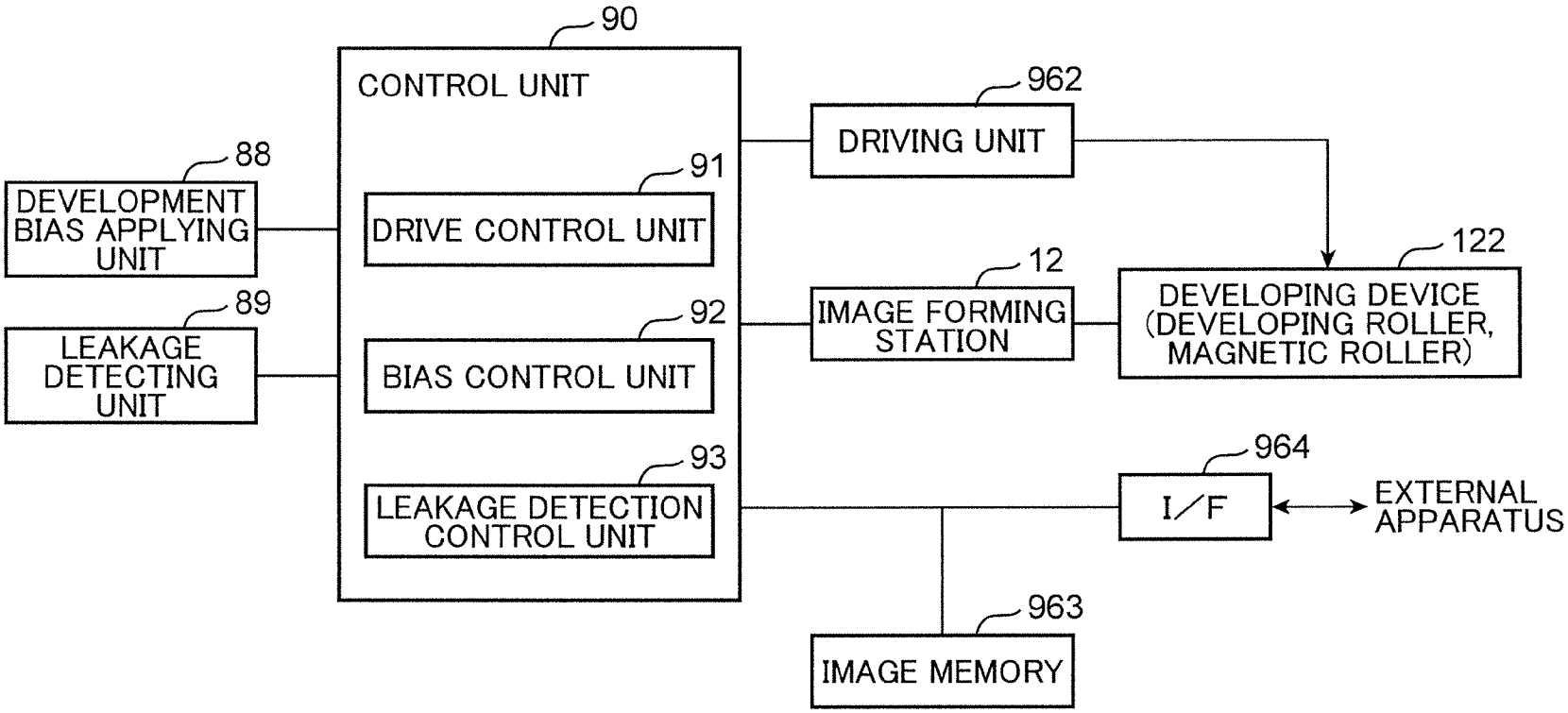
FIG. 4 is a block diagram showing an electrical configuration of the developing device according to the embodiment of the present disclosure.
Figure 5:
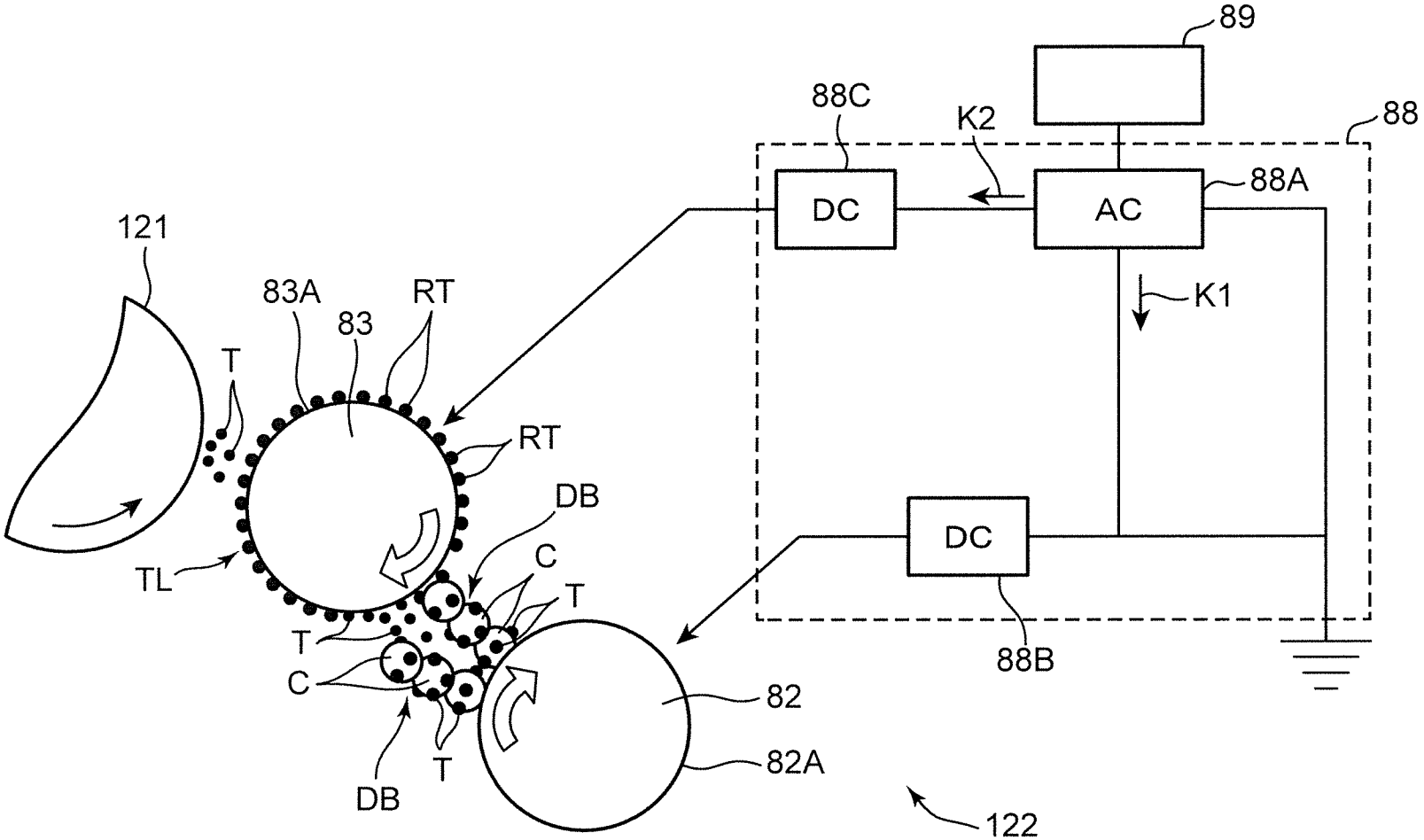
FIG. 5 is a diagram showing a developing operation of the developing device according to the embodiment of the present disclosure.

Next, a main electrical configuration of the image forming apparatus 1 is described. The image forming apparatus 1 (developing device 122) includes a control unit 90 for comprehensively controlling the operation of each component of the image forming apparatus 1. FIG. 4 is a functional block diagram of the control unit 90. FIG. 5 is a diagram showing the developing operation of the developing device 122 according to this embodiment. The control unit 90 is composed of a CPU (Central Processing Unit), a ROM (Read Only Memory) storing a control program, a RAM (Random Access Memory) used as a work area of the CPU and the like. Further, a development bias applying unit 88 (bias applying unit), a leakage detecting unit 89, the driving unit 962, an image memory 963, an I/F 964 and the like are electrically connected to the control unit 90 in addition to each member of the developing device 122.

With reference to FIG. 5, the development bias applying unit 88 is composed of a direct-current power supply and an alternating-current power supply and applies development biases, in which an alternating-current voltage is superimposed on a direct-current voltage, to the magnetic roller 82 and the developing roller 83 in the developing device 122 based on a control signal from a bias control unit 92 or a leakage detection control unit 93 to be described later. In this embodiment, the development bias applying unit 88 is composed of one transformer. In other words, development biases are applied to the magnetic roller 82 and the developing roller 83 from the common development bias applying unit 88 and a specific bias applying unit (transformer) is not arranged for each of the magnetic roller 82 and the developing roller 83. Thus, the developing device 122 is inexpensively configured. The development bias applying unit 88 applies direct-current voltages and alternating-current voltages having the same frequency and phases opposite to each other to the magnetic roller 82 and the developing roller 83.

With reference to FIG. 5, the development bias applying unit 88 includes an alternating current applying unit 88A, a first direct current applying unit 88B and a second direct current applying unit 88C. Two terminals from which development biases are output are arranged in the development bias applying unit 88. One terminal is a first terminal K1 and the other is a second terminal K2. The development bias is applied to the magnetic roller 82 via the first terminal K1 and applied to the developing roller 83 via the second terminal K2.

The leakage detecting unit 89 (FIG. 5) is electrically connected to the development bias applying unit 88. The leakage detecting unit 89 detects leakage occurring between the photoconductive drum 121 and the developing roller 83 or between the developing roller 83 and the magnetic roller 82. At this time, the leakage detecting unit 89 detects leakage based on a variation of the value of a current (overcurrent) flowing in the developing roller 83.

The driving unit 962 (FIG. 4) is composed of a motor and a gear mechanism for transmitting a torque of the motor and rotationally drives the developing roller 83, the magnetic roller 82 and the screw feeders 85, 86 in the developing device 122 in addition to the photoconductive drum 121 during a developing operation and a leakage detecting operation in accordance with a control signal from the control unit 90. In this embodiment, the developing roller 83, the magnetic roller 82 and the screw feeders 85, 86 are rotationally driven in synchronization by the driving unit 962.

The image memory 963 temporarily stores image data to be printed given from an external apparatus such as a personal computer when this image forming apparatus 1 functions as a printer. Further, the image memory 963 temporarily stores image data optically read by an ADF (Auto Document Feeder) when the image forming apparatus 1 functions as a copier.

The I/F 964 is an interface circuit for realizing data communication with external apparatuses and, for example, generates a communication signal conforming to a communication protocol of a network connecting the image forming apparatus 1 and the external apparatuses and converts a communication signal from a network side into data of a format processable by the image forming apparatus 1. A print instruction signal transmitted from a personal computer or the like is given to the control unit 90 via the I/F 964 and image data is stored in the image memory 963 via the I/F 964.

The control unit 90 functions to include a drive control unit 91, the bias control unit 92 and the leakage detection control unit 93 by the CPU executing the control program stored in the ROM.

The drive control unit 91 rotationally drives the developing roller 83, the magnetic roller 82 and the screw feeders 85, 86 by controlling the driving unit 962. Further, the drive control unit 91 rotationally drives the photoconductive drum 121 by controlling an unillustrated drive mechanism. In this embodiment, the drive control unit 91 rotationally drives each of the above members in a developing operation during an image forming operation and later-described leakage detecting operation and leakage confirming operation.

The bias control unit 92 provides a potential difference of a direct-current voltage between the magnetic roller 82 and the developing roller 83 by controlling the development bias applying unit 88 during the developing operation in which the toner is supplied from the magnetic roller 82 to the developing roller 83 and further from the developing roller 83 to the photoconductive drum 121. The toner is transferred from the magnetic roller 82 to the developing roller 83 by the above potential difference. Further, the bias control unit 92 applies alternating-current voltages having the same frequency and phases opposite to each other to the magnetic roller 82 and the developing roller 83 during the developing operation. Note that duty ratios of the alternating-current voltages are fixed as described later. The transfer of the toner from the magnetic roller 82 to the developing roller 83 is promoted by the alternating-current voltages. Further, the toner is transferred from the developing roller 83 to the photoconductive drum 121 by the above development bias applied to the developing roller 83. The development biases during the developing operation are described in detail later.

The leakage detection control unit 93 applies direct-current voltages and alternating-current voltages having opposite phases to the magnetic roller 82 and the developing roller 83 by controlling the development bias applying unit 88 during the leakage detecting operation and the leakage confirming operation to be described later. In the leakage detecting operation, an inter-peak voltage of the alternating-current voltage that leaks between the photoconductive drum 121 and the developing roller 83 or between the magnetic roller 82 and the developing roller 83 is detected out of the development bias applied to the developing roller 83. At this time, the leakage detection control unit 93 causes leakage to occur between the photoconductive drum 121 and the developing roller 83 or between the magnetic roller 82 and the developing roller 83 while increasing the inter-peak voltages in a state where a ratio of the inter-peak voltages of the alternating-current voltages applied to the developing roller 83 and the magnetic roller 82 is fixed. Then, the leakage detection control unit 93 determines whether this leakage occurs between the photoconductive drum 121 and the developing roller 83 or between the developing roller 83 and the magnetic roller 82. The leakage detecting operation is performed prior to the developing operation and the inter-peak voltage (leakage causing voltage) at which leakage occurs is detected. Then, during the subsequent developing operation, a value obtained by subtracting a predetermined offset voltage from the leakage causing voltage is set as a new inter-peak voltage to prevent the occurrence of leakage. Note that the development biases during the leakage detecting operation are described in detail later.

<Concerning the Developing Operation>

Figure 6:
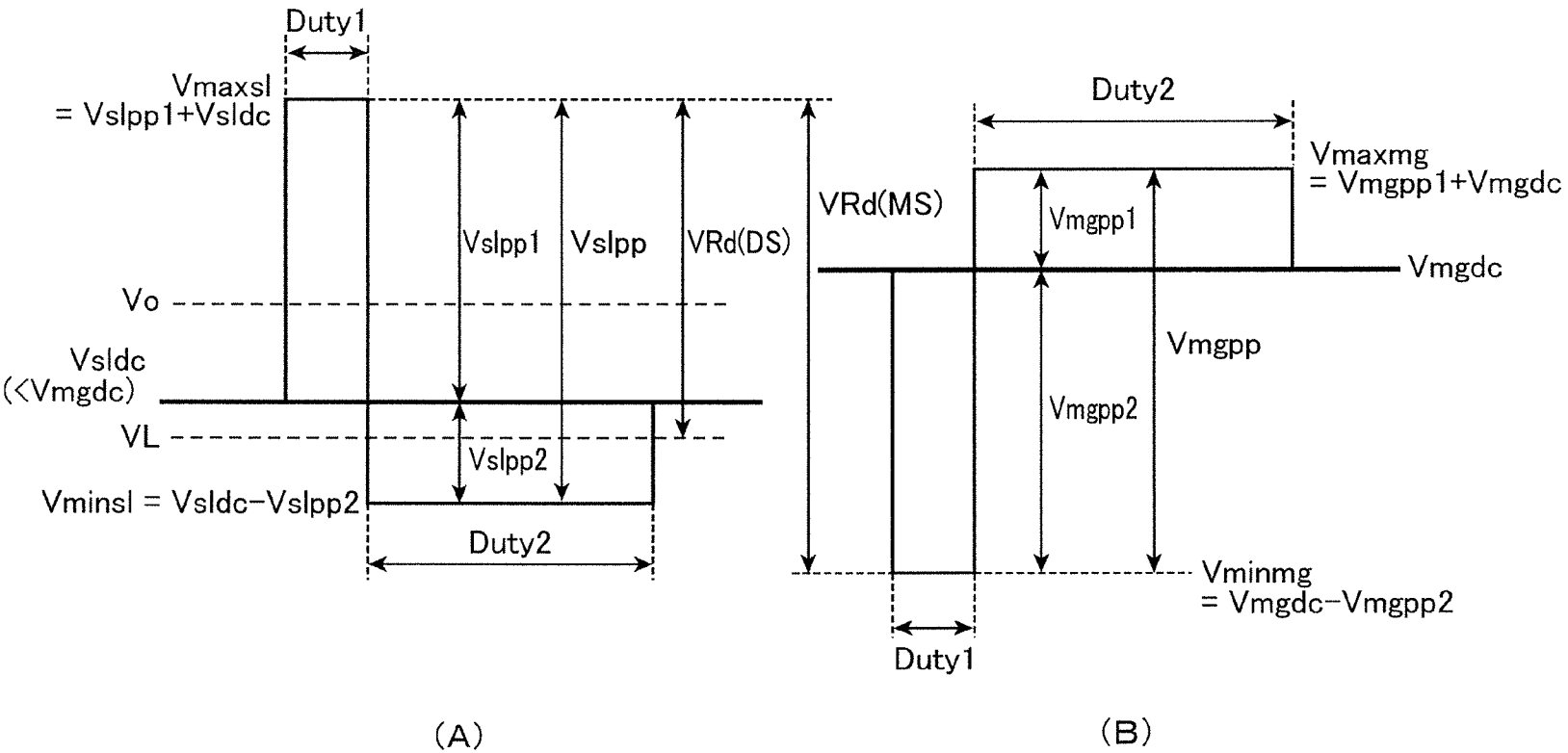
FIG. 6 is a diagram showing the waveforms of development biases during the developing operation of the developing device according to the embodiment of the present disclosure.

Next, a development mechanism of an electrostatic latent image on the photoconductive drum 121 in the developing operation is described with reference to FIGS. 5 and 6. FIG. 6 is a diagram showing the waveforms of development biases applied to the magnetic roller 82 and the developing roller 83 during the developing operation of the developing device 122 according to this embodiment. A section (A) of FIG. 6 shows the waveform of one cycle of the alternating-current voltage of the development bias applied to the developing roller 83 and a section (B) of FIG. 6 shows the waveform of one cycle of the alternating-current voltage of the development bias applied to the magnetic roller 82. Note that the sections (A) and (B) of FIG. 6 show positions adjusted in the vertical direction (bias magnitude indicating direction) to relatively compare a magnitude relationship of direct-current biases. The image forming apparatus 1 according to this embodiment has a print speed of 25 pages/min. A circumferential speed of the photoconductive drum 121 is set at 120 mm/sec. Further, in this embodiment, coating ferrite carrier having a volume specific resistance of 1010 Ω·m, a saturation magnetization of 65 emu/g and an average particle diameter of 35 μm is used as the carrier in the developer. As described above, the bias control unit 92 controls the development bias applying unit 88 to apply development biases in the case of performing the developing operation of the developing device 122 in the image forming operation of the image forming apparatus 1.

With reference to FIG. 5, the magnetic brush layer on the circumferential surface 82A of the magnetic roller 82 is conveyed toward the developing roller 83 with the rotation of the magnetic roller 82 after a layer thickness thereof is uniformly regulated by the developer regulation blade 84 (FIG. 2). Thereafter, a multitude of magnetic bristles DB in the magnetic brush layer come into contact with the circumferential surface 83A of the developing roller 83 in rotation in an area where the magnetic roller 82 and the developing roller 83 face each other.

At this time, the bias control unit 92 applies development biases, each composed of a direct-current voltage and an alternating-current voltage, to the magnetic roller 82 and the developing roller 83 as described later by controlling the development bias applying unit 88. This causes a predetermined potential difference (development potential difference ΔV, difference between Vsldc of the section (A) of FIG. 6 and Vmgdc of the section (B) of FIG. 6) between the circumferential surface 82A of the magnetic roller 82 and the circumferential surface 83A of the developing roller 83. The development potential difference ΔV is set in a range of 100 V to 350 V depending on an environment and the like. The toner layer on the developing roller 83 is thick if ΔV is large, and the toner layer on the developing roller 83 is thin if ΔV is small. Due to this potential difference, only toner particles T are transferred from the magnetic bristles DB to the circumferential surface 83A at the facing position of the circumferential surfaces 82A and 83A (facing position of the main pole 823 (FIG. 2) and the circumferential surface 83A) and the carrier particles C and the remaining toner particles of the magnetic bristles DB remain on the circumferential surface 82A. In this way, a toner layer TL having a predetermined thickness is carried on the circumferential surface 83A of the developing roller 83.

The toner layer TL on the circumferential surface 83A is conveyed toward the circumferential surface of the photoconductive drum 121 with the rotation of the developing roller 83. A superimposed voltage of a direct-current voltage and an alternating-current voltage is applied to the developing roller 83. Thus, a predetermined potential difference is generated between the circumferential surface of the photoconductive drum 121 having a potential on the surface according to the electrostatic latent image and the circumferential surface 83A of the developing roller 83. Due to this potential difference, the toner particles T of the toner layer TL are transferred to the circumferential surface of the photoconductive drum 121. In this way, the electrostatic latent image on the circumferential surface of the photoconductive drum 121 is developed to form a toner image.

Note that examples of the development biases applied to the magnetic roller 82 and the developing roller 83 by controlling the development bias applying unit 88 during the developing operation by the bias control unit 92 are as follows.

Direct-current voltage $V_{mgdc}$ of the magnetic roller 82; 550 V

Direct-current voltage $V_{slde}$ of the developing roller 83; 250 V

Alternating-current voltage ($V_{pp}$) $V_{mgpp}$ of the magnetic roller 82; 600 V (3.7 kHz)

Alternating-current voltage ($V_{pp}$) $V_{slpp}$ of the developing roller 83; 1000 V (3.7 kHz)

Duty ratio (Duty 1) of the alternating-current voltage of the developing roller 83; 27%

Duty ratio (Duty 2) of the alternating-current voltage of the magnetic roller 82; 73%

Image part potential VL of the photoconductive drum 121: +100 V

Background part potential Vo of the photoconductive drum 121; +430 V

On the other hand, FIG. 10 shows potential conditions of the magnetic roller 82 and the developing roller 83 when the above development biases and potentials on the photoconductive drum 121 are set.

A potential relationship during the developing operation is further described in detail with reference to FIG. 10 and the sections (A) and (B) of FIG. 6. As shown in FIG. 6, the alternating-current voltages of the development biases applied to the magnetic roller 82 and the developing roller 83 are set to have opposite phases during the developing roller. Thus, a cyclic potential difference based on the alternating-current voltages is set between the magnetic roller 82 and the developing roller 83 in addition to the aforementioned development potential difference ΔV composed of the direct-current voltage. With reference to the section (A) of FIG. 6, a direct-current bias $V_{sldc}$ of 250 V and an alternating-current bias $V_{slpp}$ of 1000 V including an inter-peak voltage are applied to the developing roller 83. At this time, since a duty ratio (Duty 1) on a positive side of the alternating-current bias is 27%, a peak voltage $V_{slpp1}$ on the positive side of the alternating-current bias of the developing roller 83 is 730 V. As a result, a maximum value $V_{maxs1}$ of the alternating-current voltage is 250+730=980 V (FIG. 10). Similarly, a peak voltage $V_{slpp2}$ on a negative side of the alternating-current bias of the developing roller 83 is 270 V. As a result, a minimum value $V_{mins1}$ of the alternating-current voltage is 250-270=−20 V (FIG. 10).

At this time, the image part voltage VL of the photoconductive drum 121 is set at +100 V and the background part potential Vo is set at +430V as described above. Thus, a potential difference of the direct-current bias between the developing roller 83 and the photoconductive drum 121 (interval DS) is $V_{sldc}$−VL=150 V. Further, since the alternating-current bias is applied to the developing roller 83, a potential difference between an image part of the photoconductive drum 121 and the developing roller 83 is $V_{maxs1}$−VL=980−100=880 V (FIG. 10). Further, a potential difference between a background part of the photoconductive drum 121 and the developing roller 83 is Vo−$V_{mins1}$=430−(−20)=450 V (FIG. 10).

On the other hand, with reference to the section (B) of FIG. 6, a direct-current bias $V_{mgdc}$ of 550 V and an alternating-current bias $V_{mgpp}$ of 600 V including an inter-peak voltage are applied to the magnetic roller 82. At this time, since a duty ratio (Duty 2) on a positive side of the alternating-current bias is 73%, a peak voltage $V_{mgpp1}$ on the positive side of the alternating-current bias of the magnetic roller 82 is 600×0.27=162 V. As a result, a maximum value $V_{maxmg}$ of the alternating-current voltage is 550+162=712 V (FIG. 10). Similarly, a peak voltage $V_{mgpp2}$ on a negative side of the alternating-current bias of the magnetic roller 82 is 438 V. As a result, a minimum value $V_{minmg}$ of the alternating-current voltage is 550−438=112 V (FIG. 10).

As described above, the potentials shown in the section (A) of FIG. 6 are set for the developing roller 83. Thus, a potential difference of the direct-current bias between the developing roller 83 and the magnetic roller 82 (interval MS) is Vmgdc−Vsldc=550−250=300 V. Further, since the alternating-current biases are applied to the developing roller 83 and the magnetic roller 82, a potential difference on a return side for collecting the toner from the developing roller 83 to the magnetic roller 82 is Vmaxs1−Vminmg=980−112=868 V (FIG. 10). Further, a potential difference on a feed side for supplying the toner from the magnetic roller 82 to the developing roller 83 is Vmaxmg−Vmins1=712−(−20)=732 V (FIG. 10).

By setting the potential differences as described above, the transfer of the toner from the magnetic roller 82 to the developing roller 83 and from the developing roller 83 to the photoconductive drum 121 is promoted. Thus, the development biases can be stably applied to the magnetic roller 82 and the developing roller 83 by the development bias applying unit 88 including a single transformer.

On the other hand, if specific bias applying units (transformers) are connected to the magnetic roller 82 and the developing roller 83 unlike the developing device 122 according to this embodiment, specific development biases can be respectively applied to the magnetic roller 82 and the developing roller 83 in performing the developing operation. Further, specific development biases can be applied to the magnetic roller 82 and the developing roller 83 also in detecting a leakage causing voltage at which leakage occurs between the photoconductive drum 121 and the developing roller 83 or between the developing roller 83 and the magnetic roller 82. On the other hand, in the case of providing the specific bias applying units (transformers) respectively for the magnetic roller 82 and the developing roller 83, the cost of the developing device 122 is largely increased.

In this embodiment, the leakage detecting operation of the developing device 122 can be stably performed utilizing the development bias applying unit 88 composed of one transformer as described above. Further, a power source substrate of the development bias applying unit 88 is miniaturized and space saving of the developing device 122 and the image forming apparatus 1 is realized. In addition, a complicated output control for the development bias applying unit 88 is not necessary.

The leakage detection control unit 93 (FIG. 4) performs the leakage detecting operation at a timing different from that during the imaging forming operation (during the developing operation), i.e. when the image forming apparatus 1 is shipped, when the developing device 122 or the photoconductive drum 121 is exchanged, when an environment (temperature, humidity) around the image forming apparatus 1 is changed or when a predetermined number of printing operations have been performed. In the leakage detecting operation, the leakage detection control unit 93 rotationally drives the photoconductive drum 121 and each member of the developing device 122 by controlling the drive control unit 91. Further, the leakage detection control unit 93 forms an electrostatic latent image on the photoconductive drum 121 (potential VL on the photoconductive drum 121) by controlling the charging device 123 and the exposure device 124. Then, the leakage detection control unit 93 detects an inter-peak voltage, at which leakage occurs, by detecting an overcurrent by the leakage detecting unit 89 while increasing (changing) the inter-peak voltages of the alternating-current voltages applied to the developing roller 83 and the magnetic roller 82.

Examples of the development biases applied to the magnetic roller 82 and the developing roller 83 by controlling the development bias applying unit 88 during the leakage detecting operation by the leakage detection control unit 93 are as follows.

Direct-current voltage $V_{mgdc}$ of the magnetic roller 82; 550 V

Direct-current voltage $V_{sldc}$ of the developing roller 83; 550 V

Alternating-current voltage ($V_{pp}$) $V_{mgpp}$ of the magnetic roller 82; variable (3.7 kHz)

Alternating-current voltage ($V_{pp}$) $V_{slpp}$ of the developing roller 83; variable (3.7 kHz) (where $V_{mgpp}$ and $V_{slpp}$ are respectively made variable with a ratio thereof fixed at a ratio of voltage values during the developing operation, i.e. 600:1000)

Duty ratio (Duty 1) of the alternating-current voltage of the developing roller 83; 27%

Duty ratio (Duty 2) of the alternating-current voltage of the magnetic roller 82; 73%

Image part potential VL of the photoconductive drum 121: +100 V

Background part potential Vo of the photoconductive drum 121; +430 V

Note that the leakage detecting operation is performed at the image part potential VL on the photoconductive drum 121. The background part potential Vo of the photoconductive drum 121 is a potential as a prerequisite for setting the image part potential VL by the exposure device 124.

With reference to FIGS. 10 and 6, leakage that occurs in the interval DS (between the photoconductive drum 121 and the developing roller 83) during the developing operation is mainly in the image part. Specifically, leakage occurs when a potential difference $V_{Rd}$(DS) of the section (A) of FIG. 6 is large. Further, leakage that occurs in the interval MS (between the magnetic roller 82 and the developing roller 83) during the developing operation is mainly on a return side. Specifically, leakage occurs when a potential difference $V_{Rd}$ (MS) of the sections (A), (B) of FIG. 6 is large. As described above, since a single transformer is used as the development bias applying unit 88 in this embodiment, a ratio of the inter-peak voltages of the alternating-current biases applied to the magnetic roller 82 and the developing roller 83 is fixed. This ratio is determined by a ratio of numbers of turns of predetermined coils in the development bias applying unit 88. Thus, also during the leakage detecting operation, the inter-peak voltages are increased in a state where the ratio of the inter-peak voltages of the alternating-current biases applied to the magnetic roller 82 and the developing roller 83 is kept constant as during the developing operation.

As described above, the toner layer is interposed between the photoconductive drum 121 and the developing roller 83 (interval DS). Further, the toner layer and the developer layer are interposed between the developing roller 83 and the magnetic roller 82 (interval MS). An electric resistance of the toner layer is higher than that of the developer layer. Thus, the sensitivity of leakage occurrence in response to a voltage change is higher in the interval MS than in the interval DS. As an example, leakage occurs substantially at the same inter-peak voltage when a gap in the interval DS including the toner layer is set at 100 microns and when a gap in the interval MS including the developer layer is set at 300 microns. Thus, if a predetermined leakage causing voltage is detected in the leakage detecting operation, it is desirable to set a different offset voltage according to the place of occurrence of that leakage.

Specifically, it is desirable to set a large offset voltage when leakage occurs in the interval MS than when leakage occurs in the interval DS.

On the other hand, in the case of performing the leakage detecting operation using the development bias applying unit 88 including a single transformer as described above, it has been difficult to determine whether the detected leakage has occurred between the photoconductive drum 121 and the developing roller 83 or between the developing roller 83 and the magnetic roller 82. In this embodiment, the leakage detection control unit 93 has a function of determining the place of leakage occurrence in the leakage detecting operation. Specifically, if leakage is detected at a first inter-peak voltage, the leakage detection control unit 93 applies a second inter-peak voltage larger than the first inter-peak voltage by a predetermined value and determines whether the leakage has occurred in the interval DS or in the interval MS by comparing a leakage occurrence state at the first inter-peak voltage and that at the second inter-peak voltage. In this embodiment, the leakage occurrence states compared by the leakage detection control unit 93 are leakage detection numbers indicating the numbers of leakage detections during a predetermined time. Then, the leakage detection control unit 93 determines that the leakage has occurred in the interval MS if a value obtained by dividing the leakage detection number at the second inter-peak voltage by that at the first inter-peak voltage exceeds a threshold value set in advance.

FIGS. 11 and 12 are tables showing examples of steps of the leakage detecting operation performed by the leakage detection control unit 93 in the image forming apparatus 1 under different conditions. In the image forming apparatus 1 used for the evaluation of FIG. 11, the gap in the interval DS is set at 0.12 mm and the gap in the interval MS is set at 0.3 mm. On the other hand, in the image forming apparatus 1 used for the evaluation of FIG. 12, the gap in the interval DS is set at 0.12 mm and the gap in the interval MS is set at 0.2 mm.

With reference to FIG. 11, the leakage detection control unit 93 increases the inter-peak voltage Vslpp of the alternating-current voltage of the developing roller 83 in 50 V increments from 800 V. Note that the inter-peak voltage Vmgpp of the alternating-current voltage is similarly applied to the magnetic roller 82 so that the ratio of Vmgpp to Vslpp is 600:1000. Each inter-peak voltage is applied for 1 second. During this time, the occurrence of leakage is detected at an interval of 5 ms (200 times) by the leakage detecting unit 89. As shown in FIG. 11, five leakages are first detected when Vslpp is set to 1400 V. The leakage detection control unit 93 subtracts 40 V from the detected Vslpp of 1400 V (1360 V) to detect leakage with high accuracy and continues the leakage detecting operation while increasing Vslpp in 10 V increments. Thereafter, when two leakages are detected at Vslpp=1370, Vslpp=1370 V is set as the first inter-peak voltage and stored in an unillustrated storage together with the leakage detection number. Further, the leakage detection control unit 93 applies Vslpp=1380 V (second inter-peak voltage) larger than Vslpp=1370 V by 10 V and detects the leakage detection number (4 times). Then, the leakage detection control unit 93 stores a leakage increment value (T=2) obtained by dividing the leakage detection number (4 times) at the second inter-peak voltage (Vslpp=1380 V) by the leakage detection number (2 times) at the first inter-peak voltage (Vslpp=1370) in the storage.

Similarly, with reference to FIG. 12, the leakage detection control unit 93 increases the inter-peak voltage Vslpp of the alternating-current voltage of the developing roller 83 in 50 V increments from 800 V. Thirty five leakages are first detected when Vslpp is set to 1300 V. The leakage detection control unit 93 subtracts 40 V from the detected Vslpp of 1300 V (1260 V) to detect leakage with high accuracy and continues the leakage detecting operation while increasing Vslpp in 10 V increments. Thereafter, when two leakages are detected at Vslpp=1270, Vslpp=1270 V is set as the first inter-peak voltage and stored in the unillustrated storage together with the leakage detection number. Further, the leakage detection control unit 93 applies Vslpp=1280 V (second inter-peak voltage) larger than Vslpp=1270 V by 10 V and detects the leakage detection number (15 times). Then, the leakage detection control unit 93 stores a leakage increment value (T=7.5) obtained by dividing the leakage detection number (15 times) at the second inter-peak voltage (Vslpp=1280 V) by the leakage detection number (2 times) at the first inter-peak voltage (Vslpp=1270) in the storage.

In both cases of FIGS. 11 and 12, the leakage detection control unit 93 refers to a leakage threshold value To (To=5 in this embodiment) set in advance from the storage and compares it with the leakage increment value T. Since leakage increment value T leakage threshold value To in the case of FIG. 11, the leakage detection control unit 93 determines that the place of leakage occurrence is in the interval DS (between the photoconductive drum 121 and the developing roller 83). On the other hand, since leakage increment value T≤leakage threshold value To in the case of FIG. 12, the leakage detection control unit 93 determines that the place of leakage occurrence is in the interval MS (between the magnetic roller 12 and the developing roller 83).

When the place of leakage occurrence and the leakage causing voltage (first inter-peak voltage) are detected by the leakage detection control unit 93 as described above, the bias control unit 92 sets the inter-peak voltage of the alternating-current voltage to be applied during the next developing operation. Specifically, the bias control unit 92 sets a value obtained by subtracting a first offset voltage set in advance from the first inter-peak voltage as the inter-peak voltage of the alternating-current voltage to be applied during the next developing operation if it is determined that the leakage has occurred in the interval DS at the first inter-peak voltage. On the other hand, the bias control unit 92 sets a value obtained by subtracting a second offset voltage set in advance and larger than the first offset voltage from the first inter-peak voltage as the inter-peak voltage of the alternating-current voltage to be applied during the next developing operation if it is determined that the leakage has occurred in the interval MS at the first inter-peak voltage. In this embodiment, the first offset voltage is set at 100 V and the second offset voltage is set at 150 V. Thus, in the case of FIG. 11, the bias control unit 92 sets Vslpp=1270 V obtained by subtracting 100 V from the first inter-peak voltage Vslpp=1370 V as the inter-peak voltage of the alternating-current voltage to be applied during the next developing operation. Further, in the case of FIG. 12, the bias control unit 92 sets Vslpp=1120 V obtained by subtracting 150 V from the first inter-peak voltage Vslpp=1270 V as the inter-peak voltage of the alternating-current voltage to be applied during the next developing operation. Note that the first and second offset voltages are appropriately set according to the developer used and gap conditions in the intervals DS and MS.

As just described, in this embodiment, the inter-peak voltage at which leakage occurs is detected and the place of leakage occurrence is detected during the leakage detecting operation. Then, after a different offset voltage is applied according to the place of leakage occurrence, the inter-peak voltage of the alternating-current voltage to be applied during the next developing operation is determined. Thus, safer offset voltages can be applied in accordance with places where leakage is likely to occur. As a result, the occurrence of leakage is prevented, the developing operation and the leakage detecting operation are realized by the development bias applying unit 88 including one transformer and the cost of the developing device 122 can be reduced. Particularly, in this embodiment, the leakage occurrence state at the first inter-peak voltage and that at the second inter-peak voltage are compared based on the leakage detection numbers by the leakage detection control unit 93. Thus, the place of leakage occurrence can be determined based on a change of the leakage occurrence state near the inter-peak voltage at which the leakage occurs. Further, the place of leakage occurrence can be accurately determined by comparing the leakage occurrence states based on the leakage detection numbers. Furthermore, by using the value obtained by dividing the leakage detection number at the second inter-peak voltage by that at the first inter-peak voltage, the occurrence of the leakage between the developing roller 83 and the magnetic roller 82 where leakage is likely to occur can be determined, utilizing an increasing tendency of the leakage detection number.

Figure 7:
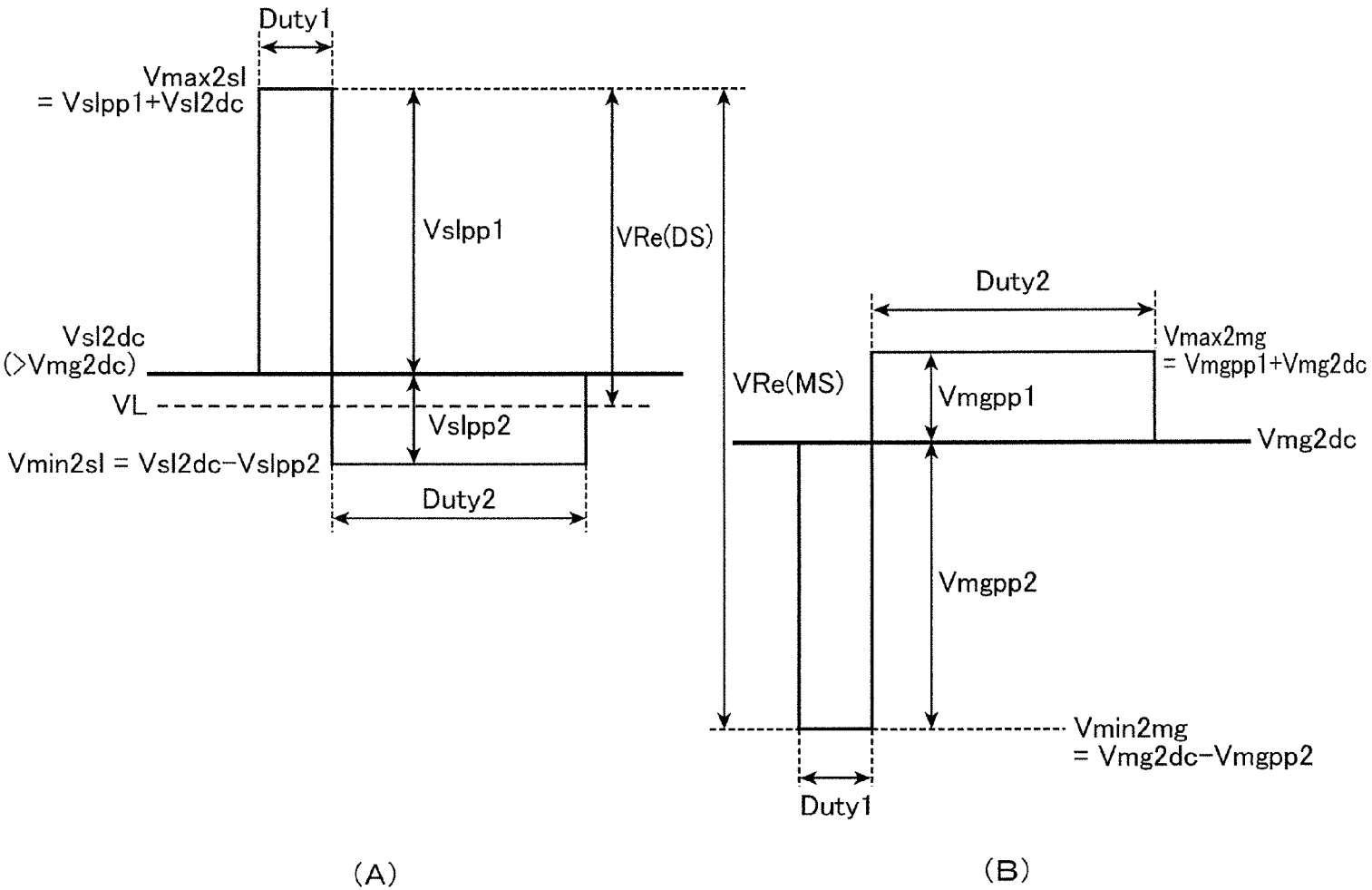
FIG. 7 is a diagram showing the waveforms of development biases during a first confirming operation of the developing device according to the embodiment of the present disclosure.
Figure 8:
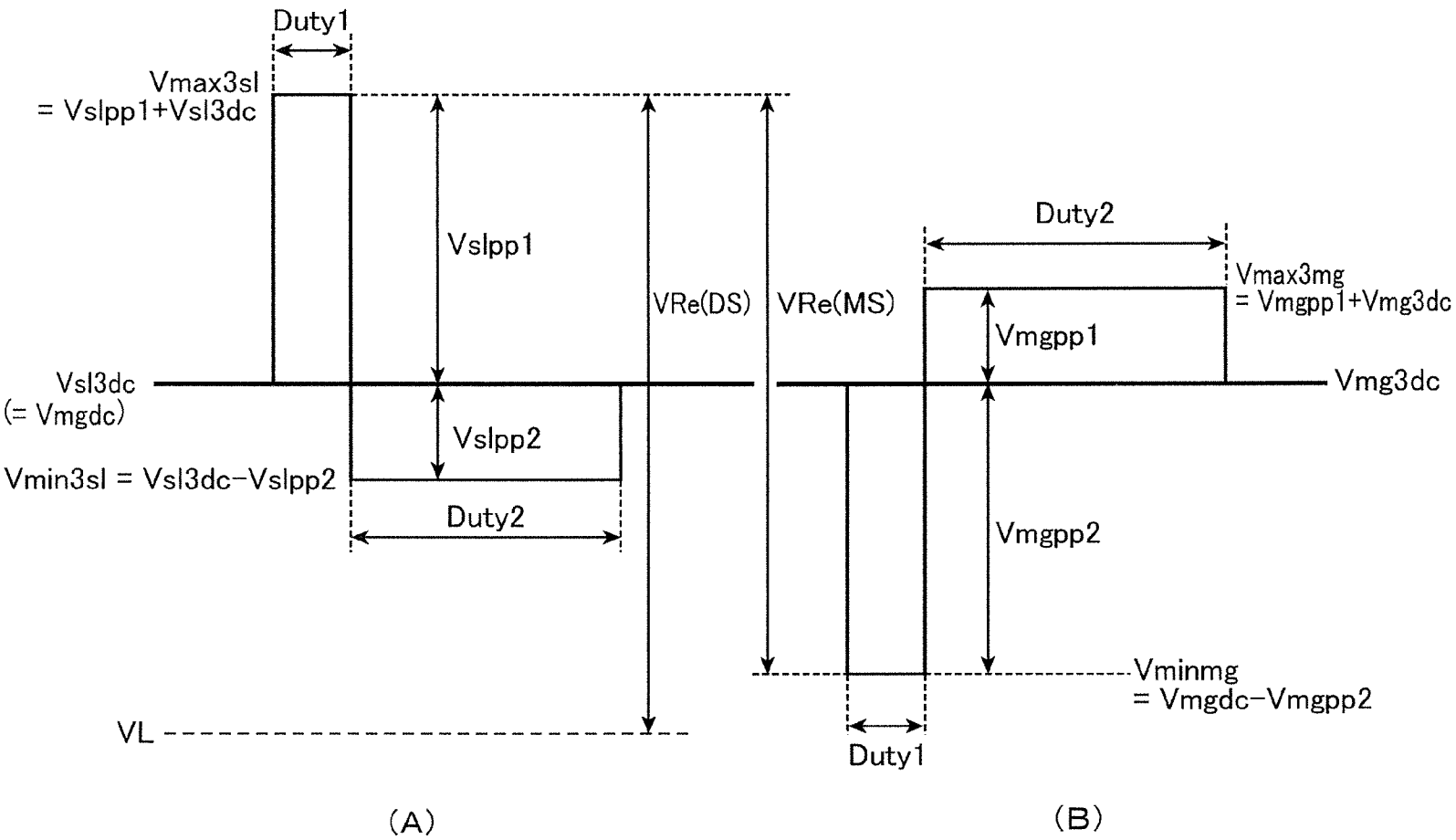
FIG. 8 is a diagram showing the waveforms of development biases during a second confirming operation of the developing device according to the embodiment of the present disclosure.

Note that the leakage threshold value To (To=5 in this embodiment) referred to by the leakage detection control unit 93 may be stored as a fixed value in the storage in advance, but is derived by the following leakage confirming operation in this embodiment. FIG. 7 is a diagram showing the waveforms of development biases during an MS leakage confirming operation (first confirming operation) of the developing device 122 according to this embodiment. A section (A) of FIG. 7 shows the waveform of one cycle of an alternating-current voltage of the development bias applied to the developing roller 83 and a section (B) of FIG. 7 shows the waveform of one cycle of an alternating-current voltage of the development bias applied to the magnetic roller 82. Note that the sections (A) and (B) of FIG. 7 show positions adjusted in the vertical direction (bias magnitude indicating direction) to relatively compare a magnitude relationship of direct-current biases. Further, FIG. 8 is a diagram showing the waveforms of development biases during a DS leakage confirming operation (second confirming operation) of the developing device 122. A section (A) of FIG. 8 shows the waveform of one cycle of an alternating-current voltage of the development bias applied to the developing roller 83 and a section (B) of FIG. 8 shows the waveform of one cycle of an alternating-current voltage of the development bias applied to the magnetic roller 82. Similarly, the sections (A) and (B) of FIG. 8 show positions adjusted in the vertical direction (bias magnitude indicating direction) to relatively compare a magnitude relationship of direct-current biases.

In the case of mounting the developing devices 122 in individual image forming apparatuses 1, there are individual variations for the gap in the interval DS and for the gap in the interval MS. Thus, in this embodiment, the leakage detection control unit 93 performs the leakage confirming operation to derive the leakage threshold value To before the image forming apparatus 1 is shipped or when the image forming apparatus 1 is installed in a place of use. Note that the leakage detection control unit 93 may perform the leakage confirming operation when an environment (temperature, humidity) in the place of use of the image forming apparatus 1 changes. The leakage confirming operation performed by the leakage detection control unit 93 includes the MS leakage confirming operation and the DS leakage confirming operation. The MS leakage confirming operation is a leakage detecting operation of actively causing leakage to occur in the interval MS. Further, the DS leakage confirming operation is a leakage detecting operation of actively causing leakage to occur in the interval DS.

Next, a potential relationship of the magnetic roller 82 and the developing roller 83 during the MS leakage confirming operation is described. Examples of the development biases applied to the magnetic roller 82 and the developing roller 83 by controlling the development bias applying unit 88 during the MS leakage confirming operation by the leakage detection control unit 93 are as follows.

Direct-current voltage $V_{mg2dc}$ of the magnetic roller 82; 50 V

Direct-current voltage $V_{sl2dc}$ of the developing roller 83; 250 V

Alternating-current voltage ($V_{pp}$) $V_{mgpp}$ of the magnetic roller 82; variable (3.7 kHz)

Alternating-current voltage ($V_{pp}$) $V_{slpp}$ of the developing roller 83; variable (3.7 kHz) (where $V_{mgpp}$ and $V_{slpp}$ are respectively made variable with a ratio thereof fixed at a ratio of voltage values during the developing operation, i.e. 600:1000)

Duty ratio (Duty 1) of the alternating-current voltage of the developing roller 83; 27%

Duty ratio (Duty 2) of the alternating-current voltage of the magnetic roller 82; 73%

Image part potential VL of the photoconductive drum 121: +100 V

With reference to FIGS. 6 and 7, in the MS leakage confirming operation, the direct-current voltages and the alternating-current voltages in FIG. 7 are so set that a ratio of a potential difference VRe(MS) between the developing roller 83 and the magnetic roller 82 to a potential difference VRe (DS) between the photoconductive drum 121 and the developing roller 83 is larger than a ratio of the potential difference VRd(MS) between the developing roller 83 and the magnetic roller 82 to the potential difference VRd(DS) between the photoconductive drum 121 and the developing roller 83 formed by the direct-current voltages and the alternating-current voltages during the developing operation of FIG. 6. Specifically, as compared with FIG. 6, the direct-current voltage Vmg2*dc* of the magnetic roller 82 is lowered from 550 V to 50V (Vmgdc>Vmg2*dc*) in FIG. 7. Thus, Vsl2*dc* becomes higher than Vmg2*d* (Vsl2*dc*>Vmg2*dc*) and it becomes difficult to transfer the toner from the magnetic roller 82 to the developing roller 83. Since VRe(MS) is largely enlarged as shown in FIG. 7, the occurrence of leakage in the interval MS can be promoted.

The leakage detection control unit 93 performs an operation similar to the previously described leakage detecting operation shown in FIGS. 11 and 12 while maintaining the potential relationship shown in FIG. 7. Note that, in the MS leakage confirming operation, after the leakage detection number is detected at the second inter-peak voltage, the leakage detection number is detected also at a third inter-peak voltage even higher by 10 V. As a result, the leakage detection number of the leakage that occurred at each of the first, second and third inter-peak voltages in the interval MS is detected.

Next, a potential relationship of the magnetic roller 82 and the developing roller 83 during the DS leakage confirming operation is described. Examples of the development biases applied to the magnetic roller 82 and the developing roller 83 by controlling the development bias applying unit 88 during the DS leakage confirming operation by the leakage detection control unit 93 are as follows.

Direct-current voltage $V_{mg3dc}$ of the magnetic roller 82; 700 V

Direct-current voltage $V_{sl3dc}$ of the developing roller 83; 700 V

Alternating-current voltage ($V_{pp}$) $V_{mgpp}$ of the magnetic roller 82; variable (3.7 kHz)

Alternating-current voltage ($V_{pp}$) $V_{slpp}$ of the developing roller 83; variable (3.7 kHz) (where $V_{mgpp}$ and $V_{slpp}$ are respectively made variable with a ratio thereof fixed at a ratio of voltage values during the developing operation, i.e. 600: 1000)

Duty ratio (Duty 1) of the alternating-current voltage of the developing roller 83; 27%

Duty ratio (Duty 2) of the alternating-current voltage of the magnetic roller 82; 73%

Image part potential VL of the photoconductive drum 121: +100 V

With reference to FIGS. 6 and 8, in the DS leakage confirming operation, the direct-current voltages and the alternating-current voltages in FIG. 8 are so set that a ratio of a potential difference $V_{Re}$(DS) between the developing roller 83 and the photoconductive drum 121 to a potential difference VRe(MS) between the magnetic roller 82 and the developing roller 83 is larger than a ratio of the potential difference $V_{Rd}$(DS) between the developing roller 83 and the photoconductive drum 121 to the potential difference $V_{Rd}$(MS) between the magnetic roller 82 and the developing roller 83 formed by the direct-current voltages and the alternating-current voltages during the developing operation of FIG. 6. Specifically, as compared with FIG. 6, the direct-current voltage $V_{sl3dc}$ of the developing roller 83 is raised from 250 V to 700V ($V_{sl3dc}$>$V_{sldc}$) in FIG. 8. Note that although $V_{mg3dc}$ and $V_{sl3dc}$ are set at the same value in FIG. 8, it is sufficient to satisfy a relationship of $V_{mg3dc}$ $V_{sl3dc}$. In this case, since $V_{Re}$(MS) is largely enlarged as shown in FIG. 8, the occurrence of leakage in the interval DS can be promoted.

The leakage detection control unit 93 performs an operation similar to the previously described leakage detecting operation shown in FIGS. 11 and 12 while maintaining the potential relationship shown in FIG. 8. Note that, in the DS leakage confirming operation, after the leakage detection number is detected at the second inter-peak voltage, the leakage detection number is detected also at the third inter-peak voltage even higher by 10 V. As a result, the leakage detection number of the leakage that occurred at each of the first, second and third inter-peak voltages in the interval DS is detected.

Figure 9:
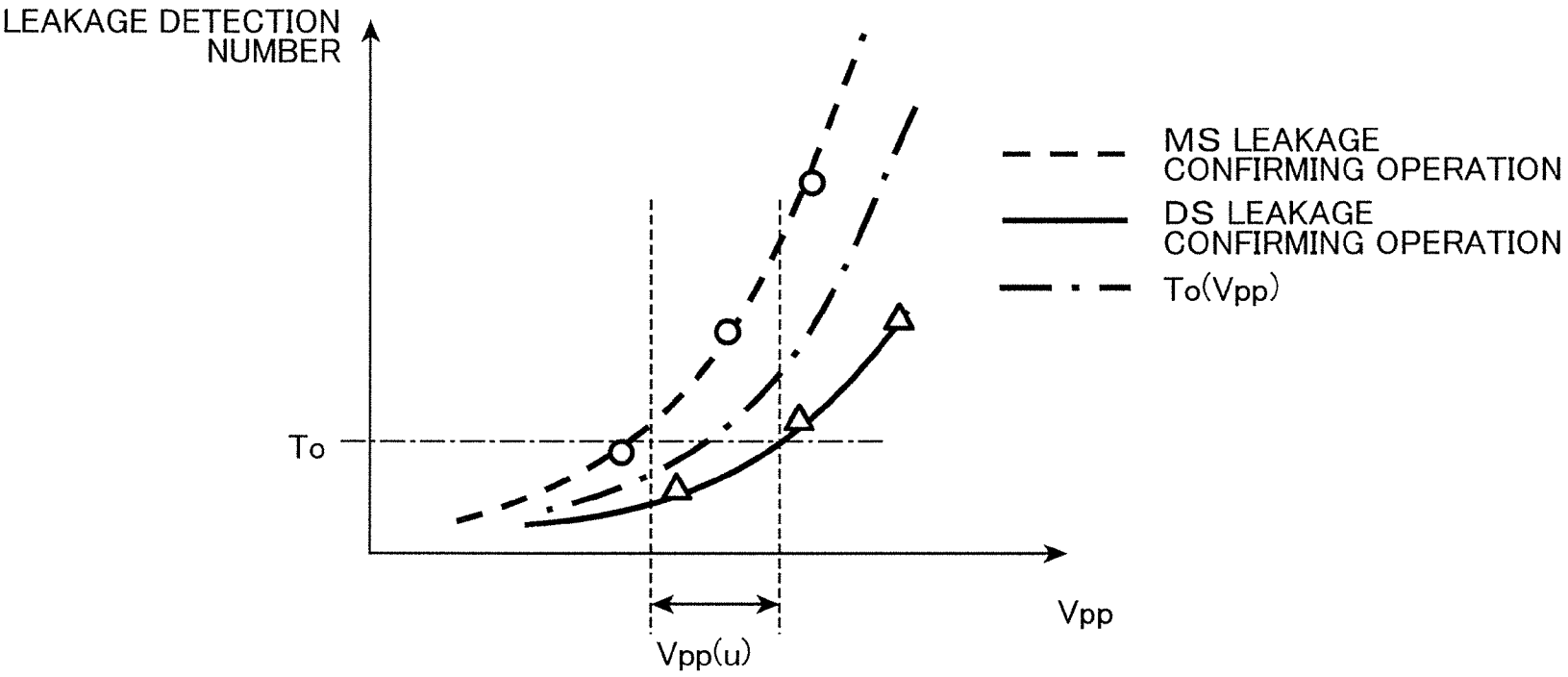
FIG. 9 is a graph showing a relationship of an inter-peak voltage and a leakage detection number during a leakage confirming operation of the developing device according to the embodiment of the present disclosure.

The leakage detection control unit 93 derives the leakage threshold value To from the relationship of the inter-peak voltage and the leakage detection number detected in the above MS leakage confirming operation and DS leakage confirming operation. FIG. 9 is a graph showing a relationship of the inter-peak voltage and the leakage detection number during the leakage confirming operation of the developing device 122 according to this embodiment. For the aforementioned reason, a larger leakage detection number is detected in the interval MS than in the interval DS even at the same inter-peak voltage. The leakage detection control unit 93 determines the leakage threshold value To as a threshold value capable of determining the leakage detection number in the interval MS and that in the interval DS as shown in FIG. 9 in a range of the inter-peak voltage Vpp (u) actually used during the developing operation. Note that the leakage threshold value To may be set between the leakage detection number in the interval MS and that in the interval DS as shown by To(Vpp) as a variation with respect to a horizontal axis Vpp of FIG. 9.

As just described, according to this embodiment, the leakage threshold value To corresponding to an environment and an individual difference of the image forming apparatus 1 can be accurately derived by performing the leakage confirming operation in advance. Particularly, the leakage threshold value To is accurately derived by comparing the MS leakage confirming operation of actively causing leakage to occur between the magnetic roller 82 and the developing roller 83 and the DS leakage confirming operation of actively causing leakage to occur between the photoconductive drum 121 and the developing roller 83.

Although the developing device 122 and the image forming apparatus 1 provided with the same according to the embodiment of the present disclosure have been described above, the present disclosure is not limited to this. For example, the following modifications may be adopted.

(1) In the above embodiment, a mode is described in which the leakage detecting unit 89 detects leakage based on a variation of the value of the current (overcurrent) flowing in the developing roller 83. The present disclosure is not limited to this. The leakage detecting unit 89 may adopt another mode such as the one in which leakage is detected by detecting the number of times the above current value exceeds a threshold value set in advance.

(2) Further, although a mode is described in which the toner is charged to have a positive polarity in the above embodiment, the present disclosure is not limited to this. Even if the toner is charged to have a negative polarity, it is possible to apply development biases to the developing roller 83 and the magnetic roller 82 from a single transformer and perform the leakage detecting operation by executing a control similar to the above. In this case, the surface potential of the photoconductive drum 121 and the polarities of the development biases applied to the magnetic roller 82 and the developing roller 83 may be adjusted according to the polarity of the toner.

(3) The comparison of the leakage occurrence state at the first inter-peak voltage and that at the second inter-peak voltage by the leakage detection control unit 93 is not limited to the one based on the leakage detection numbers. The leakage occurrence states may be compared based on integral values of current values exceeding a predetermined current value threshold value or peak values of current values at the time of detecting leakage.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a development housing configured to store a developer containing toner to be charged to a predetermined polarity and carrier;

a developer carrier configured to receive the developer in the development housing and carry a developer layer by being rotated;

a toner carrier configured to receive the toner from the developer layer, carry a toner layer and supply the toner to an image carrier having an electrostatic latent image formed on a surface and carrying a toner image developed by the toner by being rotated in a state in contact with the developer layer;

a bias applying unit including one transformer and configured to apply direct-current voltages and alternating-current voltages having the same frequency and phases opposite to each other to the developer carrier and the toner carrier;

a leakage detecting unit configured to detect leakage occurring between the image carrier and the toner carrier or leakage occurring between the toner carrier and the developer carrier;

a bias control unit configured to provide a predetermined potential difference of the direct-current voltage between the toner carrier and the developer carrier and apply the alternating-current voltages so that the toner is transferred from the developer carrier to the toner carrier by controlling the bias applying unit during a developing operation in which the toner is supplied from the toner carrier to the image carrier; and a leakage detection control unit configured to detect a value of an inter-peak voltage, at which the leakage occurs, by changing inter-peak voltages in a state where a ratio of the inter-peak voltages of the alternating-current voltages applied to the toner carrier and the developer carrier is fixed and determine whether the leakage occurs between the image carrier and the toner carrier or between the toner carrier and the developer carrier during a leakage detecting operation different from the developing operation;

wherein the bias control unit sets a value obtained by subtracting a first offset voltage set in advance from a first inter-peak voltage as the inter-peak voltage of the alternating-current voltage to be applied during the next developing operation if the occurrence of leakage between the image carrier and the toner carrier at the first inter-peak voltage is determined by the leakage detection control unit and sets a value obtained by subtracting a second offset voltage set in advance and larger than the first offset voltage from the first inter-peak voltage as the inter-peak voltage of the alternating-current voltage to be applied during the next developing operation if the occurrence of leakage between the developer carrier and the toner carrier at the first inter-peak voltage is determined by the leakage detection control unit.

2. A developing device according to claim 1, wherein:

the leakage detection control unit determines whether leakage occurs between the image carrier and the toner carrier or between the toner carrier and the developer carrier by applying a second inter-peak voltage larger than the first inter-peak voltage by a predetermined value and comparing a leakage occurrence state at the first inter-peak voltage and that at the second inter-peak voltage if the leakage is detected at the first inter-peak voltage.

3. A developing device according to claim 2, wherein:

the leakage occurrence states compared by the leakage detection control unit are leakage detection numbers indicating the numbers of leakage detections within a predetermined time.

4. A developing device according to claim 3, wherein:

the leakage detection control unit determines that the leakage has occurred between the developer carrier and the toner carrier if a value obtained by dividing the leakage detection number at the second inter-peak voltage by that at the first inter-peak voltage exceeds a threshold value set in advance.

5. A developing device according to claim 4, wherein:

the leakage detection control unit performs a leakage confirming operation of deriving the threshold value prior to the leakage detecting operation;

the leakage confirming operation includes:

a first confirming operation of causing leakage to occur between the toner carrier and the developer carrier by setting the direct-current voltages and the alternating-current voltages so that a ratio of a potential difference between the developer carrier and the toner carrier to that between the image carrier and the toner carrier is larger than a ratio of a potential difference between the developer carrier and the toner carrier to that between the image carrier and the toner carrier formed by the direct-current voltages and the alternating-current voltages during the developing operation; and a second confirming operation of causing leakage to occur between the image carrier and the toner carrier by setting the direct-current voltages and the alternating-current voltages so that a ratio of the potential difference between the image carrier and the toner carrier to that between the developer carrier and the toner carrier is larger than a ratio of the potential difference between the image carrier and the toner carrier to that between the developer carrier and the toner carrier formed by the direct-current voltages and the alternating-current voltages during the developing operation; and the leakage detection control unit derives the threshold value by comparing a relationship of the inter-peak voltage and the leakage occurrence state in the first confirming operation and that of the inter-peak voltage and the leakage occurrence in the second confirming operation.

6. A developing device according to claim 1, wherein:

the leakage detecting unit detects the leakage based on a variation of the value of a current flowing in the toner carrier; and the leakage detection control unit causes the leakage to occur between the image carrier and the toner carrier or between the toner carrier and the developer carrier while increasing the inter-peak voltages of the alternating-current voltages.

7. An image forming apparatus, comprising:

a developing device according to claim 1; and the image carrier configured to carry the electrostatic latent image and the toner image.

* * * * *